US009886885B2

(12) United States Patent
Kim et al.

(10) Patent No.: US 9,886,885 B2
(45) Date of Patent: Feb. 6, 2018

(54) GAMMA CORRECTION CIRCUIT AND DISPLAY DEVICE

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Taehyun Kim, Beijing (CN); Wenchu Han, Beijing (CN); Lei Dai, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 350 days.

(21) Appl. No.: 14/448,360

(22) Filed: Jul. 31, 2014

(65) Prior Publication Data

US 2015/0302788 A1 Oct. 22, 2015

(30) Foreign Application Priority Data

Apr. 18, 2014 (CN) ..... 2014 1 0157998

(51) Int. Cl.

*G09G 5/10* (2006.01)
*G09G 3/20* (2006.01)
*G09G 3/36* (2006.01)

(52) U.S. Cl.

CPC ..... *G09G 3/2007* (2013.01); *G09G 3/36* (2013.01); *G09G 3/3696* (2013.01); (Continued)

(58) Field of Classification Search

CPC combination set(s) only.
See application file for complete search history.

(56) References Cited

U.S. PATENT DOCUMENTS

2002/0186230 A1* 12/2002 Kudo ..... G09G 3/3607 345/690
2007/0052735 A1* 3/2007 Chou ..... H04N 17/04 345/690

(Continued)

FOREIGN PATENT DOCUMENTS

CN 1573425 A * 2/2005 ..... G09G 3/3688
CN 1697010 A 11/2005

(Continued)

OTHER PUBLICATIONS

Chinese Office Action dated Sep. 6, 2015 issued in corresponding Chinese Application No. 201410157998.6.

*Primary Examiner* — Jennifer Mehmood
*Assistant Examiner* — Sosina Abebe
(74) *Attorney, Agent, or Firm* — Nath, Goldberg & Meyer; Joshua B. Goldberg

(57) ABSTRACT

The present invention discloses a gamma correction circuit and a display device, relates to the field of display technology, and solves the problem of display distortion of part of display panels due to changes in ideal gamma curves for part of batches of display panels of the same model. The gamma correction circuit provided by the embodiment of the present invention is used for performing gamma correction on the display panel, and comprises gamma registers and D/A converting units, wherein gamma voltages obtained by converting, by the D/A converting units, values in the gamma registers are used to form a test gamma curve, and the gamma correction circuit further comprises correction units used for correcting the values in the gamma registers, or correcting reference voltages of the D/A converting units, when a deviation exists between the test gamma curve and an idea gamma curve of the display panel.

12 Claims, 4 Drawing Sheets

(52) U.S. Cl.
CPC ..... *G09G 2310/027* (2013.01); *G09G 2320/0233* (2013.01); *G09G 2320/0673* (2013.01); *G09G 2330/028* (2013.01)

(56) References Cited

U.S. PATENT DOCUMENTS

| | | | | |
|---|---|---|---|---|
| 2007/0262972 | A1* | 11/2007 | Nakata ..... | G09G 3/3696 345/204 |
| 2009/0278773 | A1* | 11/2009 | Chegal ..... | G09G 3/3275 345/77 |

FOREIGN PATENT DOCUMENTS

| | | | |
|---|---|---|---|
| CN | 1811537 | A | 8/2006 |
| JP | H0851557 | A | 2/1996 |
| TW | I326443 | B | 6/2010 |

* cited by examiner

| No. | gamma register | value in gamma register | gamma voltage before correction | offset register | value in offset register | corrected value in gamma register | corrected gamma voltage |
|---|---|---|---|---|---|---|---|
| 1 | V0 | 00H | 4.3V | R1 | 0 | 00H | 4.3V |
| 2 | V1 | 02H | 4.1V | | | 02H | 4.1V |
| 3 | V2 | 04H | 3.9V | R2 | 1 | 05H | 4.0V |
| 4 | V3 | 09H | 3.7V | | | 0AH | 3.8V |
| 5 | V7 | 13H | 3.5V | | | 14H | 3.6V |
| 6 | V13 | 17H | 3.3V | R3 | 2 | 19H | 3.5V |
| 7 | V19 | 1AH | 3.1V | | | 1CH | 3.3V |
| 8 | V25 | 1FH | 2.9V | | | 21H | 3.1V |
| 9 | V32 | 23H | 2.7V | R4 | 2 | 25H | 2.9V |
| 10 | V38 | 27H | 2.5V | R5 | 2 | 29H | 2.7V |
| 11 | V44 | 2AH | 2.3V | | | 2CH | 2.5V |
| 12 | V50 | 2EH | 2.1V | | | 30H | 2.3V |
| 13 | V56 | 31H | 1.9V | R6 | 2 | 33H | 2.1V |
| 14 | V60 | 37H | 0.9V | | | 39H | 1.1V |
| 15 | V61 | 3CH | 0.7V | | | 3EH | 0.9V |
| 16 | V62 | 41H | 0.5V | R7 | 0 | 41H | 0.5V |
| 17 | V63 | 45H | 0.3V | | | 45H | 0.3V |

GAMMA CORRECTION CIRCUIT AND DISPLAY DEVICE

FIELD OF THE INVENTION

The present invention relates to the field of display technology, and particularly to a gamma correction circuit and a display device.

BACKGROUND OF THE INVENTION

The working mechanism of a liquid crystal display panel is as follows: orientation of liquid crystal molecules sandwiched between opposite transparent electrodes are controlled by voltages applied to the opposite transparent electrodes, so that the amount of light which enters liquid crystal molecules via one electrode and leaves the display panel via the other electrode is controlled; the more the amount of transmitted light is, the higher the brightness will be.

As for a liquid crystal display panel, a nonlinear relationship presents between the applied voltage (i.e. the voltage applied to the transparent electrodes) and light transmittance (grayscale) achieving the best display effect. A curve drawn according to this relationship is referred to as an idea gamma curve. Due to the nonlinear relationship between the applied voltage and the grayscale, a certain increment in the applied voltage does not result in the same increment in the grayscale. Thus, when the liquid crystal display panel is controlled by the applied voltages whose values linearly correspond to the brightness of input images to output images, the output images may be brighter or darker (distorted) as compared to the input images. Therefore, it is necessary to correct the voltages applied to the electrodes according to the idea gamma curve of the liquid crystal display panel so as to avoid distortion of output images. This process of correction is referred to as gamma correction.

A gamma correction circuit is required to perform gamma correction on a liquid crystal display panel. The gamma correction circuit comprises gamma registers and D/A converting units. Data of input images is stored in the gamma registers after converted to digital signals, and is then D/A converted by the D/A converting units to generate gamma voltages corresponding to respective grayscales, and the gamma voltages are finally output to data lines of pixel units.

In the process of operating the above gamma correction circuit, a curve drawn according to correspondence between the gamma voltages generated after D/A conversion and grayscales is referred to as a test gamma curve. Since a gamma correction circuit is designed according to the idea gamma curve, the test gamma curve should coincide with the idea gamma curve. However, due to the limitation of production process, for some batches of display panels of the same model, the idea gamma curve may change. If these display panels use the same gamma correction circuit as the other batches of display panels, the corresponding test gamma curve will not change, which results in a large deviation between the test gamma curve and the changed ideal gamma curve and further leads to display distortion of a part of display panels of the same model.

SUMMARY OF THE INVENTION

An object of the present invention is to provide a gamma correction circuit and a display device, which solve the problem of display distortion of a part of display panels due to changes in ideal gamma curves for some batches of display panels of the same model.

To achieve the above object, the following technical solutions are adopted in embodiments of the present invention.

A gamma correction circuit, used for performing gamma correction on a display panel, comprising gamma registers and D/A converting units, wherein gamma voltages obtained by converting, by the D/A converting units, values in the gamma registers are used to form a test gamma curve, and the gamma correction circuit further comprises correction units used for correcting the values in the gamma registers, or correcting reference voltages of the D/A converting units, when a deviation exists between the test gamma curve and an idea gamma curve of the display panel.

Preferably, the correction units are offset registers, which are used for correcting the values in the gamma registers when a deviation exists between the test gamma curve and the idea gamma curve of the display panel.

Further preferably, the gamma correction circuit further comprises adders, each of which is used for adding the value in the gamma register and the value in the offset register and outputting the resulting value to the gamma register so as to correct the value in the gamma register.

Preferably, the number of the gamma registers is equal to or larger than two; and each of the offset registers is used for correcting values in at least two of the gamma registers simultaneously.

Preferably, the offset registers are implemented by multi time program logic devices.

Preferably, each of the D/A converting units comprises a plurality of resistors connected in series between a voltage input end and a ground end, a voltage at the voltage input end is the reference voltage of the D/A converting unit; and each of the correction units comprises a variable resistor connected in series between a power supply and the voltage input end and is used for correcting the reference voltage of the D/A converting unit when a deviation exists between the test gamma curve and the idea gamma curve of the display panel.

Further preferably, each of the D/A converting units further comprises a multiplexer, which comprises a plurality of input terminals and one input terminal, the plurality of input terminals are used for obtaining a plurality of different input voltages from nodes between respective adjacent resistors, respectively, and the output terminal is used for outputting one of the plurality of input voltages according to the value of the corresponding gamma register.

An embodiment of the present invention also provides a display device comprising the above-described gamma correction circuit.

BRIEF DESCRIPTION OF THE DRAWINGS

In order to explain the technical solutions in embodiments of the present invention or in the prior art more clearly, the accompanying drawings used in description of the embodiments or the prior art will be briefly introduced below.

Apparently, the accompanying drawings described below illustrate merely some embodiments of the present invention, and for those skilled in the art, other drawings can be obtained based on these drawings without creative efforts.

DETAILED DESCRIPTION OF THE EMBODIMENTS

The technical solutions in embodiments of the present invention will be described clearly and completely in conjunction with accompanying drawings used in embodiments of the present invention. Apparently, the embodiments to be described are only a part but not all of the embodiments of the present invention Other embodiments obtained by those skilled in the art without creative efforts, based on the embodiments in the present invention, fall into the scope of the present invention.

Figure 1:
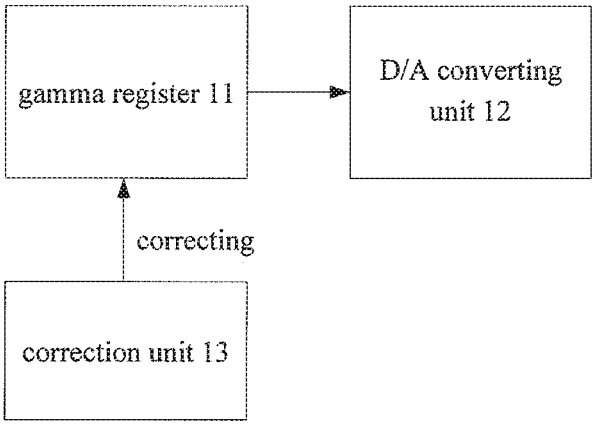
FIG. 1 is a block diagram of a gamma correction circuit provided by an embodiment of the present invention.
Figure 2:
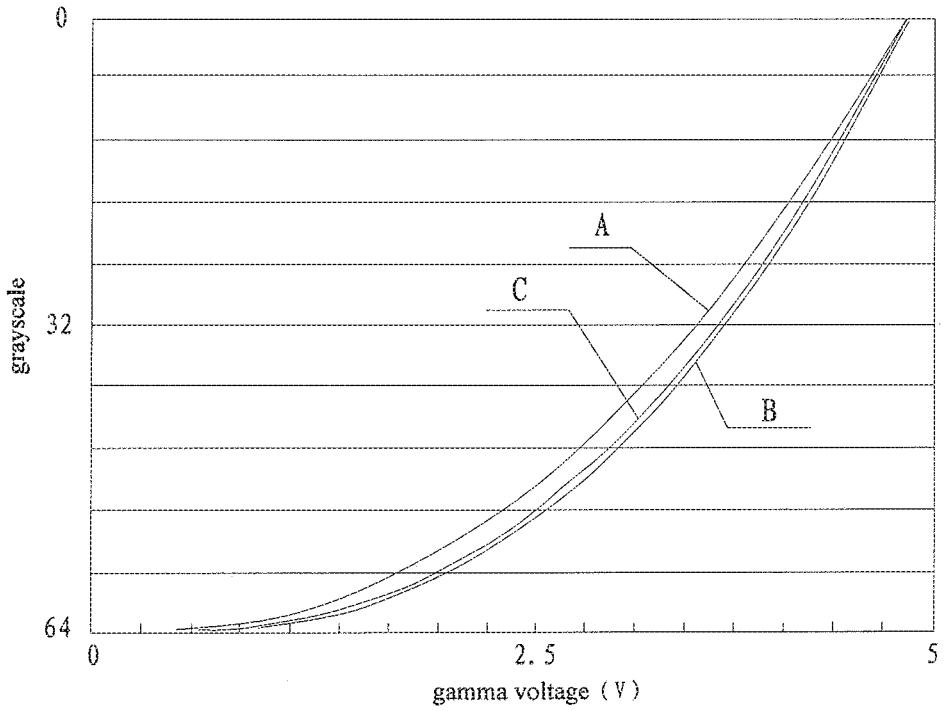
FIG. 2 is a diagram illustrating a comparison among a corrected test gamma curve generated by using a gamma correction circuit provided by an embodiment of the present invention, a test gamma curve before correction, and an ideal gamma curve.

An embodiment of the present invention provides a gamma correction circuit, which is used for performing gamma correction on a display panel. As shown in FIG. 1, the gamma correction circuit comprises gamma registers 11 and D/A converting units 12. Gamma voltages obtained by converting, by the D/A converting units 12, values in the gamma registers 11 are used to form a test gamma curve A (i.e. a test gamma curve before correction). As shown in FIG. 2, the gamma correction circuit further comprises correction units 13, which are used for correcting the values in the gamma registers 11, or correcting reference voltages of the D/A converting units 12, when a deviation exists between the test gamma curve A and an idea gamma curve B of the display panel.

In the gamma correction circuit provided by the embodiment of the present invention, due to the correction units 13, when a deviation exists between the test gamma curve and the idea gamma curve of the display panel, the values in the gamma registers 11 may be corrected by the correction units 13 so that corrected gamma voltages may be obtained by converting, by the D/A converting units 12, the corrected values in the gamma registers, or the reference values of the D/A converting units 12 may be corrected by the correction units 13 so that the gamma voltages output from the D/A converting units 12 are corrected to obtain the corrected gamma voltages. A corrected test gamma curve C generated from the corrected gamma voltages is closer to the idea gamma curve B than the test gamma curve A before correction, that is, the deviation between the corrected test gamma curve C and the idea gamma curve B is smaller than that between the test gamma curve A before correction and the idea gamma curve B. When the brightness of output images of the display panel is low, the brightness of output images may be increased properly through correction operation of the correction units 13; and when the brightness of output images of the display panel is high, the brightness of output images may be decreased properly through correction operation of the correction units 13. In this way, optimal display effect may be achieved, and display distortion is further avoided.

It should be noted that, the above display panel may include various display panels such as a liquid crystal display panel, an OLED display panel and the like, which is not limited here.

Figure 6:
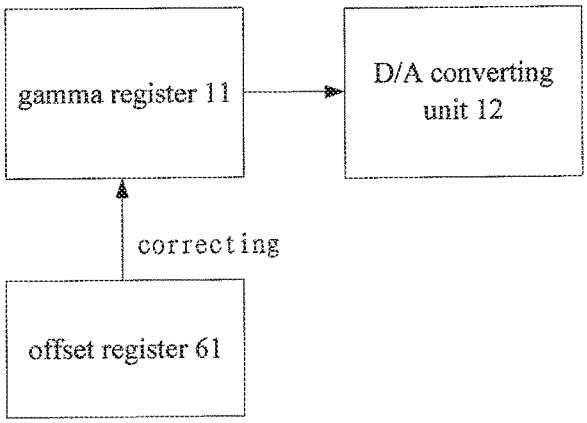
FIG. 6 is a block diagram of the first gamma correction circuit provided by an embodiment of the present invention.

In the gamma correction circuit provided by the above embodiment, the correction units 13 may be offset registers 61, as shown in FIG. 6, used for correcting the values in the gamma registers 11 when a deviation exists between the test gamma curve A and the idea gamma curve B of the display panel. Since only an operation of writing the register needs to be performed and values of correction may be adjusted at any time through an operation of reading the register when the offset registers 61 are used to perform correction operation, and the correction operation is thus simple and intuitive.

Figures 3, 4:
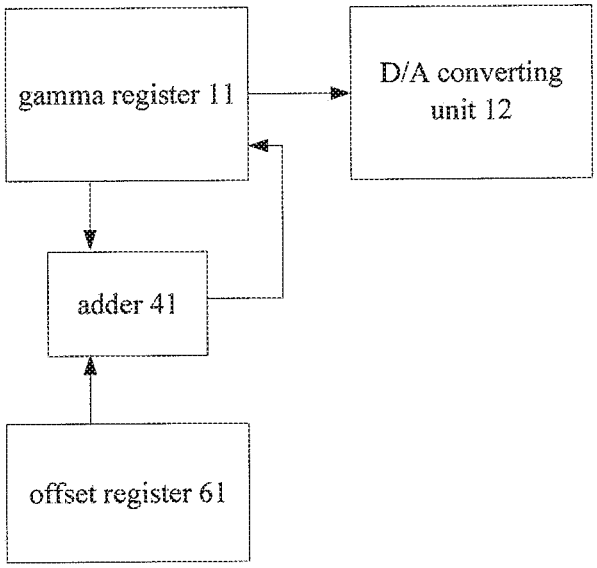
FIG. 3 is a table illustrating an example of correcting values in 17 gamma registers in a gamma correction circuit provided by an embodiment of the present invention.
FIG. 4 is a block diagram of a modification of a first gamma correction circuit provided by an embodiment of the present invention.

In general, there are 16-27 gamma registers in the gamma correction circuit, and the values stored in the gamma registers determine magnitudes of gamma voltages when corresponding grayscales are displayed. FIG. 3 illustrates a case that there are 17 gamma registers in the gamma correction circuit, wherein V0 denotes a gamma register storing a value corresponding to a grayscale of level 0, and V13 denotes a gamma register storing a value corresponding to a grayscale of level 13.

It is assumed that when the value in V0 is 0, a gamma voltage of 4.3V may be generated after conversion of the D/A converting unit 12. When the generated gamma voltage is applied to a data line of a pixel unit, the pixel unit displays a grayscale of level 0. It is further assumed that if the value in the gamma register is increased by 1, the generated gamma voltage is increased by 0.1V. Thus when the brightness of the displayed grayscale of level 0 is not sufficient, the value in V0 may be set to be 1. As a result, a gamma voltage of 4.4V is generated, thus displaying, on the pixel unit, the grayscale of level 0 with increased brightness. In this way, it can be achieved that the values stored in the gamma registers determine magnitudes of gamma voltages when corresponding grayscales are displayed.

In FIG. 3, there are seven offset registers which are denoted by R1-R7, respectively. A value obtained by adding the value in the offset register to the value in the gamma register is taken as the corrected value in the gamma register, so that gamma voltages are adjusted. Further, in FIG. 3, the values in the gamma registers are denoted in hexadecimal numeral. For example, as shown in FIG. 3, a corrected value of 5 (=4+1) in the gamma register, which may generate a gamma voltage of 4.0V after converted by the D/A converting unit 12, may be obtained when the value of 1 in an offset register R2 corresponding to a gamma register V2 is added to the value of 04 H in the gamma register V2, which may generate a gamma voltage of 3.9V after converted by the D/A converting unit 12.

In the gamma correction circuit provided by the above embodiment, adders 41 as shown in FIG. 4 may be further included. As is known, an adder is a digital logic device and is used for performing binary addition operation on an addend and an augend. In the present embodiment, the adder 41 is used for adding the value in the gamma register 11 and the value in the offset register 61 and for outputting the resulting value to the gamma register 11 so as to correct the value in the gamma register 11.

It should be noted that, there are various circuit structures that can be used to correct the value in the gamma register 11 with the value in the offset register 61. The above method of providing the adders 41 is simple, fewer devices need to be added, and layout area of the gamma correction circuit may not be increased excessively. In addition, when the offset register 61 is used to correct the value in the gamma register 11, the way of correction is not limited to adding operation (with the adders), but include other operations that can correct numerals, such as subtraction, multiplication, division or the like.

Figure 5:
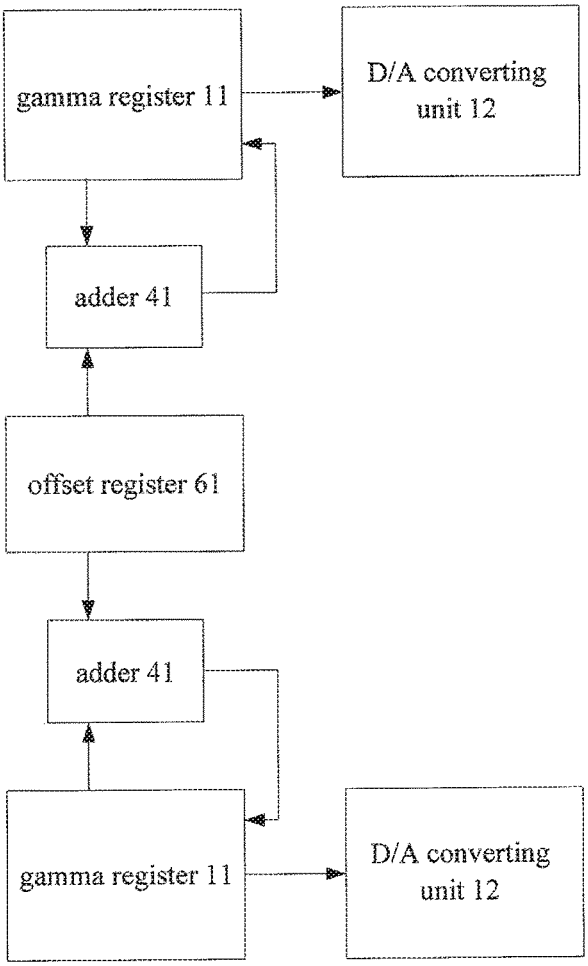
FIG. 5 is a block diagram illustrating a case in which two gamma registers in a gamma correction circuit provided by an embodiment of the present invention share one offset register.

Further, in the gamma correction circuit provided by the above embodiment, there are a plurality of gamma registers 11, and each of the offset registers 61 may be used to correct values in at least two gamma registers 11 simultaneously. FIG. 5 is a schematic diagram of a configuration in which one offset register 61 corrects values in two gamma registers 11 through two adders 41, respectively. In this way, multiple gamma registers 11 having the same value of correction may share one offset register 61. For example, as shown in FIG. 3, as the values of correction required to correct the values in gamma registers V2, V3, and V7 are 1 (corresponding to the value in offset register R1), the gamma registers V2, V3, and V7 may share one offset register R1. In this way, the amount of devices to be used can be reduced, and further excessive increase in the layout area of the gamma correction circuit can be avoided.

In the gamma correction circuit provided by the above embodiment, the offset register 61 may be implemented by a multi time program (MTP) logic device. Such device is characterized in that values stored therein will not disappear after power-off, and in that values stored therein can be modified multiple times by means of programming. The offset register 16 implemented by MTP logic device can automatically load preset values when the display panel is powered on, so that automatic correction of the gamma registers is achieved. In addition, the characteristic that values stored in the MTP logic device can be modified multiple times enables a manufacturer of the display panel to modify values in the offset registers 61 according to differences among different panels, so as to correct values of the gamma voltages according to the changed ideal gamma curve.

Figure 7:
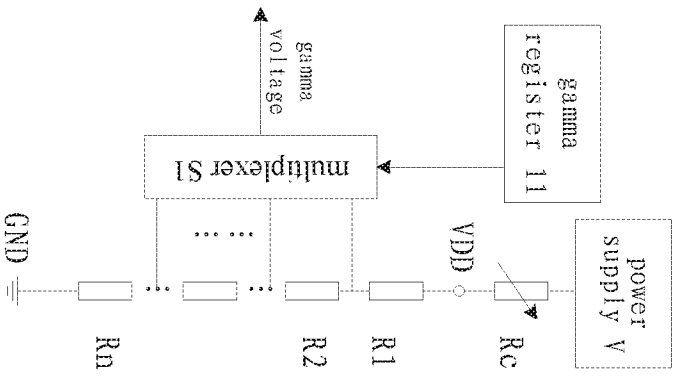
FIG. 7 is a block diagram of a second gamma correction circuit provided by an embodiment of the present invention.

In the gamma correction circuit provided by the above embodiment, as shown in FIG. 7, the D/A converting unit 12 comprises a plurality of resistors (R1, R2, . . . , Rn) connected in series between a voltage input end VDD and a ground end GND, and a multiplexer S1 comprising a plurality of input terminals and one output terminal. The plurality of input terminals of the multiplexer S1 are used for obtaining a plurality of different input voltages from nodes between respective adjacent resistors, respectively, and the output terminal of the multiplexer S1 is used for outputting one of the plurality of input voltages as a gamma voltage corresponding to one grayscale. The value in the gamma register 11 is used for selecting one channel of the multiplexer S1, thus determining output voltage of the multiplexer S1. When the gamma correction circuit is operating, the voltage input end VDD is connected to a power supply V, the voltage at the voltage input end is a reference voltage of the D/A converting unit 12, and the D/A converting unit 12 outputs a gamma voltage corresponding to one grayscale by taking the reference voltage as a reference.

As shown in FIG. 7, a variable resistor Rc with an adjustable resistance, as the correcting unit, may be connected in series between the power supply V and the voltage input end VDD. When the resistance of the variable resistor Rc is changed and the voltage of the power supply V keeps unchanged, the voltage at the voltage input end VDD will change as the voltage of the variable resistor Rc changes, so that the reference voltage of the D/A converting unit 12 is changed, the output gamma voltage is changed, and finally, the brightness of the display panel can be adjusted to an optimal value. It should be noted that the reference voltage of the D/A converting unit 12 may be changed in other manners, which is not limited here.

It can be seen from the gamma voltage—grayscale characteristic curve of the display panel, when the gamma voltage changes, the brightness of the grayscale in the mid-range changes to a large extent, and the brightness of grayscale of level 0 (all white) and level 255 (all dark) changes to a small extent. With the reference voltage increased slightly, the brightness of grayscales in the mid-range decreases greatly, and the brightness of all white and all dark just decreases slightly, so that the corrected test gamma curve C moves toward the ideal gamma curve B and gradually approaches the ideal gamma curve B.

An embodiment of the present invention also provides a display device, comprising the above-described gamma correction circuit. The display device may be any product or component with display function, such as a liquid crystal display, a liquid crystal television, a digital frame, a mobile phone, a tablet PC or the like.

The above is merely specific implementations of the present invention, but the protection scope of the present invention is not limited thereto. Variations or substitutions that can be easily conceived by those skilled in the art should be included in the protection scope of the present invention. Therefore, the protection scope of the present invention should be defined by the appending claims.

The invention claimed is:

1. A gamma correction circuit, used for performing gamma correction on a display panel, comprising gamma registers and D/A converting units, wherein gamma voltages obtained by converting, by the D/A converting units, values in the gamma registers are used to form a test gamma curve, and the gamma correction circuit further comprises correction units used for correcting the values in the gamma registers, or correcting reference voltages of the D/A converting units, when a deviation exists between the test gamma curve and an ideal gamma curve of the display panel, and the correction units include offset registers, and each of the offset registers is used for correcting values in at least two of the gamma registers simultaneously.

2. The gamma correction circuit according to claim 1, further comprising adders, each of which is used for adding the value in the gamma register and the value in the offset register and outputting the resulting value to the gamma register so as to correct the value in the gamma register.

3. The gamma correction circuit according to claim 2, wherein, the offset registers are implemented by multi time program logic devices.

4. The gamma correction circuit according to claim 1, wherein, the offset registers are implemented by multi time program logic devices.

5. The gamma correction circuit according to claim 1, wherein, each of the D/A converting units comprises a plurality of resistors connected in series between a voltage input end and a ground end, a voltage at the voltage input end is the reference voltage of the D/A converting unit; and each of the correction units comprises a variable resistor connected in series between a power supply and the voltage input end and is used for correcting the reference voltage of the D/A converting unit when a deviation exists between the test gamma curve and the ideal gamma curve of the display panel.

6. The gamma correction circuit according to claim 5, wherein, each of the D/A converting units further comprises a multiplexer which comprises a plurality of input terminals and one input terminal, the plurality of input terminals are used for obtaining a plurality of different input voltages from nodes between respective adjacent resistors, respectively, and the output terminal is used for outputting one of the plurality of input voltages according to the value of the corresponding gamma register.

7. A display device, comprising a gamma correction circuit used for performing gamma correction on the display panel, the gamma correction circuit comprising gamma registers and D/A converting units, wherein gamma voltages obtained by converting, by the D/A converting units, values in the gamma registers are used to form a test gamma curve, and the gamma correction circuit further comprises correction units used for correcting the values in the gamma registers, or correcting reference voltages of the D/A converting units, when a deviation exists between the test gamma curve and an ideal gamma curve of the display panel, and the correction units include offset registers, and each of the offset registers is used for correcting values in at least two of the gamma registers simultaneously.

8. The display panel according to claim 7, wherein, the gamma correction circuit further comprises adders, each of which is used for adding the value in the gamma register and the value in the offset register and outputting the resulting value to the gamma register so as to correct the value in the gamma register.

9. The display panel according to claim 8, wherein, the offset registers are implemented by multi time program logic devices.

10. The display panel according to claim 7, wherein, the offset registers are implemented by multi time program logic devices.

11. The display panel according to claim 7, wherein, each of the D/A converting units comprises a plurality of resistors connected in series between a voltage input end and a ground end, a voltage at the voltage input end is the reference voltage of the D/A converting unit; and each of the correction units comprises a variable resistor connected in series between a power supply and the voltage input end and is used for correcting the reference voltage of the D/A converting unit when a deviation exists between the test gamma curve and the ideal gamma curve of the display panel.

12. The display panel according to claim 11, wherein, each of the D/A converting units further comprises a multiplexer which comprises a plurality of input terminals and one input terminal, the plurality of input terminals are used for obtaining a plurality of different input voltages from nodes between respective adjacent resistors, respectively, and the output terminal is used for outputting one of the plurality of input voltages according to the value of the corresponding gamma register.

* * * * *